US010561893B2

(12) United States Patent
Chatterton et al.

(10) Patent No.: US 10,561,893 B2
(45) Date of Patent: Feb. 18, 2020

(54) LINEAR BEARING FOR CONSOLE POSITIONING

(71) Applicant: ICON Health & Fitness, Inc., Logan, UT (US)

(72) Inventors: N. Jeffrey Chatterton, Logan, UT (US); Luke Downs, Smithfield, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 114 days.

(21) Appl. No.: 15/712,908

(22) Filed: Sep. 22, 2017

(65) Prior Publication Data

US 2018/0099179 A1 Apr. 12, 2018

Related U.S. Application Data

(60) Provisional application No. 62/407,055, filed on Oct. 12, 2016.

(51) Int. Cl.

| | |
|---|---|
| ***A63B 22/02*** | (2006.01) |
| ***A63B 22/00*** | (2006.01) |
| *A63B 71/06* | (2006.01) |

(52) U.S. Cl.

CPC ..... *A63B 22/0242* (2013.01); *A63B 22/0023* (2013.01); *A63B 22/02* (2013.01); *A63B 22/0235* (2013.01); *A63B 2071/068* (2013.01); *A63B 2225/00* (2013.01); *A63B 2230/06* (2013.01)

(58) Field of Classification Search

CPC . A63B 22/0023; A63B 22/0242; A63B 22/02; A63B 22/0235

See application file for complete search history.

(56) References Cited

U.S. PATENT DOCUMENTS

| | | | |
|---|---|---|---|
| 4,913,396 | A | 4/1990 | Dalebout et al. |
| 5,192,255 | A | 3/1993 | Dalebout et al. |
| 5,279,528 | A | 1/1994 | Dalebout et al. |
| 5,372,559 | A | 12/1994 | Dalebout et al. |
| 5,409,435 | A | 4/1995 | Daniels |
| 5,512,025 | A | 4/1996 | Dalebout et al. |
| 5,527,245 | A | 6/1996 | Dalebout |
| 5,529,553 | A | 6/1996 | Finlayson |
| 5,595,556 | A | 1/1997 | Dalebout et al. |

(Continued)

FOREIGN PATENT DOCUMENTS

| | | |
|---|---|---|
| CN | 2014337631 | 5/2015 |
| CN | 105797307 | 7/2016 |

(Continued)

OTHER PUBLICATIONS

U.S. Appl. No. 16/378,022, filed Apr. 8, 2019, William T. Dalebout.

(Continued)

*Primary Examiner* — Megan Anderson

(74) *Attorney, Agent, or Firm* — Ray Quinney & Nebeker

(57) ABSTRACT

An exercise device includes a base and an upright structure connected to the base. The upright structure includes a stationary portion connected to the base, a height adjustable portion connected to the stationary portion, and a linear actuator that moves the height adjustable portion in response to a command from a user.

14 Claims, 5 Drawing Sheets

(56) References Cited

U.S. PATENT DOCUMENTS 5,607,375 A 3/1997 Dalebout
5,662,557 A 9/1997 Watterson et al.
5,672,140 A 9/1997 Watterson et al.
5,674,156 A 10/1997 Watterson et al.
5,674,453 A 10/1997 Watterson et al.
5,676,624 A 10/1997 Watterson et al.
5,683,332 A 11/1997 Watterson et al.
5,702,325 A 12/1997 Watterson et al.
5,704,879 A 1/1998 Watterson et al.
5,718,657 A 2/1998 Dalebout et al.
5,743,833 A 4/1998 Watterson et al.
5,762,584 A 6/1998 Daniels
5,772,560 A 6/1998 Watterson et al.
5,827,155 A 10/1998 Jensen
5,860,893 A 1/1999 Watterson et al.
5,860,894 A 1/1999 Dalebout et al.
5,899,834 A 5/1999 Dalebout et al.
5,951,441 A 9/1999 Dalebout
6,033,347 A 3/2000 Dalebout et al.
6,174,267 B1 1/2001 Dalebout
6,280,362 B1 8/2001 Dalebout et al.
6,350,218 B1 2/2002 Dalebout et al.
6,471,622 B1 10/2002 Hammer et al.
6,652,424 B2 11/2003 Dalebout
6,730,002 B2 5/2004 Hald et al.
6,743,153 B2 6/2004 Watterson et al.
6,761,667 B1 7/2004 Cutler et al.
6,786,852 B2 9/2004 Watterson et al.
6,821,230 B2 11/2004 Dalebout et al.
6,830,540 B2 12/2004 Watterson
6,974,404 B1 12/2005 Watterson et al.
7,052,442 B2 5/2006 Watterson
7,192,388 B2 3/2007 Dalebout et al.
7,285,075 B2 10/2007 Cutler et al.
7,344,481 B2 * 3/2008 Watterson ..... A63B 22/02 482/4
7,377,882 B2 5/2008 Watterson
7,537,549 B2 5/2009 Nelson et al.
7,540,828 B2 6/2009 Watterson et al.
7,563,203 B2 7/2009 Dalebout et al.
7,645,212 B2 1/2010 Ashby et al.
7,713,172 B2 5/2010 Watterson et al.
7,815,550 B2 10/2010 Watterson et al.
7,862,475 B2 1/2011 Watterson
7,862,483 B2 1/2011 Hendrickson et al.
8,876,668 B2 11/2014 Hendrickson et al.
8,920,288 B2 12/2014 Dalebout
9,028,368 B2 5/2015 Ashby et al.
9,039,578 B2 5/2015 Dalebout
9,072,930 B2 7/2015 Ashby et al.
9,095,740 B2 8/2015 Wu
9,138,615 B2 9/2015 Olson et al.
9,149,683 B2 9/2015 Smith
9,186,549 B2 11/2015 Watterson et al.
9,278,248 B2 3/2016 Tyger
9,289,648 B2 3/2016 Watterson
9,352,185 B2 5/2016 Hendrickson et al.
9,352,186 B2 5/2016 Watterson
9,367,668 B2 6/2016 Flynt
9,375,605 B2 6/2016 Tyger
9,387,387 B2 7/2016 Dalebout
9,403,051 B2 8/2016 Cutler
9,480,874 B2 11/2016 Cutler
9,517,378 B2 12/2016 Ashby et al.
9,521,901 B2 12/2016 Dalebout
9,579,544 B2 2/2017 Watterson
9,616,278 B2 4/2017 Olson
9,623,281 B2 4/2017 Hendrickson
9,675,839 B2 6/2017 Dalebout
9,682,307 B2 6/2017 Dalebout
9,694,234 B2 7/2017 Dalebout et al.
9,694,242 B2 7/2017 Ashby
9,737,755 B2 8/2017 Dalebout
9,764,184 B2 9/2017 Kueker
9,767,785 B2 9/2017 Ashby
9,808,672 B2 11/2017 Dalebout
9,849,330 B2 * 12/2017 Lagree ..... A63B 21/023
9,889,334 B2 2/2018 Ashby et al.
9,968,823 B2 5/2018 Cutler
10,010,755 B2 7/2018 Watterson
10,010,756 B2 7/2018 Watterson
10,086,254 B2 10/2018 Watterson
10,207,143 B2 2/2019 Dalebout
10,207,145 B2 2/2019 Tyger
10,207,148 B2 2/2019 Powell
10,252,109 B2 4/2019 Watterson
10,272,317 B2 4/2019 Watterson
10,279,212 B2 5/2019 Dalebout et al.
10,376,736 B2 8/2019 Powell et al.
2013/0172152 A1 7/2013 Watterson
2013/0172153 A1 7/2013 Watterson
2013/0178334 A1 7/2013 Brammer
2013/0190136 A1 * 7/2013 Watterson ..... A63B 71/0622 482/8
2013/0281241 A1 10/2013 Watterson
2014/0121066 A1 * 5/2014 Huang ..... A63B 22/02 482/54
2014/0274574 A1 9/2014 Shorten et al.
2014/0274579 A1 9/2014 Olson
2015/0141222 A1 * 5/2015 DeLaCruz ..... A47C 9/002 482/142
2015/0253210 A1 9/2015 Ashby et al.
2015/0352396 A1 12/2015 Dalebout
2016/0058335 A1 3/2016 Ashby
2016/0206922 A1 7/2016 Dalebout et al.
2017/0056715 A1 3/2017 Dalebout et al.
2017/0266483 A1 9/2017 Dalebout et al.
2017/0266532 A1 9/2017 Watterson
2017/0266533 A1 9/2017 Dalebout
2018/0001135 A1 1/2018 Powell
2018/0036585 A1 2/2018 Powell
2018/0099179 A1 4/2018 Chatterton et al.
2018/0099180 A1 4/2018 Wilkinson
2018/0099205 A1 * 4/2018 Watterson ..... A63B 71/0619
2018/0117385 A1 5/2018 Watterson et al.
2018/0117419 A1 * 5/2018 Jackson ..... A63B 22/025
2018/0154205 A1 6/2018 Watterson
2018/0154207 A1 6/2018 Hochstrasser
2018/0154208 A1 * 6/2018 Powell ..... A63B 22/0023
2018/0154209 A1 6/2018 Watterson
2019/0058370 A1 2/2019 Tinney
2019/0151698 A1 5/2019 Olson
2019/0192898 A1 6/2019 Dalebout
2019/0192952 A1 6/2019 Powell
2019/0269958 A1 9/2019 Dalebout et al.
2019/0275366 A1 9/2019 Powell

FOREIGN PATENT DOCUMENTS

KR 101990000049 8/1990
KR 101571361 11/2015
TW 582287 4/2004

OTHER PUBLICATIONS

U.S. Appl. No. 16/435,104, filed Jun. 7, 2019, Dale Alan Buchanan.
U.S. Appl. No. 16/508,827, filed Jul. 11, 2019, ICON Health & Fitness, Inc.
U.S. Appl. No. 16/508,860, filed Jul. 11, 2019, ICON Health & Fitness, Inc.
International Search Report and Written Opinion issued in PCT Application No. PCT/US2017/057443 dated Feb. 28, 2018.
English Translation of Taiwan Office Action and Search Report issued in Taiwan application 106134684 dated Jun. 25, 2018.
International Search Report and Written Opinion issued in PCT Application No. PCT/US2017/054930 dated Jan. 16, 2018.
English Translation of Taiwan Office Action and Search Report issued in Taiwan application 106134446 dated May 24, 2018.

* cited by examiner

LINEAR BEARING FOR CONSOLE POSITIONING

RELATED APPLICATIONS

This application claims priority to U.S. Provisional Patent Application Ser. No. 62/407,055 titled "Linear Bearing for Console Positioning" and filed on Oct. 12, 2016, which application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling, among others activities. In contrast, anaerobic exercise typically involves high intensity exercises over a short duration of time. Popular forms of anaerobic exercise include strength training and short distance running.

Many choose to perform aerobic exercises indoors, such as in a gym or their home. Often, a user will use an aerobic exercise machine to perform an aerobic workout indoors. One type of aerobic exercise machine is a treadmill, which is a machine that has a running deck attached to a support frame. The running deck can support the weight of a person using the machine. The running deck incorporates a conveyor belt that is driven by a motor. A user can run or walk in place on the conveyor belt by running or walking at the conveyor belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical trainers, rowing machines, stepper machines, and stationary bikes, to name a few.

One type of treadmill is disclosed in U.S. Pat. No. 7,344,481 issued to Scott R. Watterson, et al. In this reference, the invention relates to a self-adjusting treadmill having a movable console and a self-adjusting cushioning assembly. According to one aspect of the invention in this reference, the movable console and the self-adjusting cushioning assembly of the treadmill automatically adjust based on user parameters. The user parameters can be input by the user or automatically detected when the user steps on the treadmill by the movable console and/or the cushioning mechanisms. In one embodiment, when the user stands on the treadmill, the console detects the height of the user and is automatically raised or lowered to tailor the positioning of the console relative to the height of the user.

SUMMARY

In one embodiment, an exercise device includes a base and an upright structure connected to the base. The upright structure includes a stationary portion connected to the base, a height adjustable portion connected to the stationary portion, and a linear actuator that moves the height adjustable portion in response to a command from a user.

The linear actuator may be a screw linear actuator.

The screw linear actuator may include a worm gear and a threaded rod with a thread form that meshes with the worm gear.

The upright structure may further include a console, a first post supporting the console, and a second post supporting the console. The linear actuator may be incorporated into one of the first post and the second post.

The stationary portion may include a stationary cavity defined by an inner stationary surface of a stationary section of the first post. The cavity may include an internal stationary width. The height adjustable portion may include a movable cavity defined by an inner movable surface of a movable portion of the first post. The movable cavity may include an internal movable width. The internal stationary width may be greater than the internal movable width. A region of the movable portion may reside within the stationary cavity, and the inner stationary surface guides the movable portion when the linear actuator applies a force to move the movable section.

The exercise device may include a motor disposed within the first post, a threaded rod, and a first rod end is in communication with the motor. The threaded rod may be partially disposed within the stationary cavity and partially disposed within the movable cavity.

The threaded rod may include a second rod end connected to the movable section of the first post.

The threaded rod may include a second rod end connected to the stationary section of the first post.

The exercise device may be a treadmill.

The exercise device may include an exercise deck attached to at least one of the base and the upright structure.

The exercise device may include an incline mechanism that adjusts the incline angle of the exercise deck.

The incline mechanism may be in communication with the linear actuator. The linear actuator may move the height adjustable portion in response to the incline mechanism adjusting the angle of the exercise device. The command from the user may be an incline angle adjustment command.

The incline mechanism may include a protrusion attached to an underside of the exercise deck, an opening defined in the protrusion, and a vibration reduction element incorporated into the protrusion.

The vibration reduction element may include an elastic liner attached to the opening.

The incline mechanism may include an expandable element, a first end of the expandable element being connected to the protrusion, a second end of the expandable element being connected to the base, and a fastener of the first end being in contact with the vibration reduction element.

In one embodiment, a treadmill includes a base, an upright structure connected to the base. The upright structure includes a stationary portion connected to the base, a height adjustable portion connected to the stationary portion, and a screw linear actuator that moves the height adjustable portion in response to a command from a user. The screw linear bearing includes a worm gear, and a threaded rod with a thread form that meshes with the worm gear. The exercise machine includes an exercise deck attached to at least one of the base and the upright structure and an incline mechanism that adjusts the incline angle of the exercise deck. The incline mechanism is in communication with the worm gear. The worm gear rotates the threaded rod in response to the incline mechanism adjusting the angle of the exercise device.

The upright structure may include a console, a first post supporting the console, and a second post supporting the console. The screw linear actuator may be incorporated into at least one of the first post and the second post.

The stationary portion may include a stationary cavity defined by an inner stationary surface of a stationary section of the first post. The cavity may include an internal stationary width. The height adjustable portion may include a movable cavity defined by an inner movable surface of a movable portion of the first post. The movable cavity may include an internal movable width. The internal stationary width may be greater than the internal movable width. A region of the movable portion may reside within the stationary cavity. The inner stationary surface may guide the movable portion when the screw linear actuator applies a force to move the movable section.

The treadmill may include a motor disposed within the first post, a threaded rod, and a first rod end in communication with the motor. The threaded rod may be partially disposed within the stationary cavity and partially disposed within the movable cavity.

In one embodiment, a treadmill includes a base and an upright structure connected to the base. The upright structure includes a stationary portion connected to the base. The stationary portion includes a stationary cavity defined by an inner stationary surface of a stationary section of the first post. The cavity includes an internal stationary width. A height adjustable portion is connected to the stationary portion. A movable cavity is defined by an inner movable surface of a movable portion of the first post. The movable cavity includes an internal movable width. The internal stationary width is greater than the internal movable width. A region of the movable portion resides within the stationary cavity, and a screw linear actuator moves the height adjustable portion in response to a command from a user. The inner stationary surface guides the movable portion when the screw linear actuator applies a force to move the movable section. The treadmill includes a console is incorporated into the height adjustable portion of the upright structure, a first post supporting the console, and a second post supporting the console. The screw linear actuator is incorporated into one of the first post and the second post. The screw linear actuator includes a motor disposed within the first post, a threaded rod, a first rod end in communication with the motor, and a worm gear that meshes with the threaded rod. The threaded rod is partially disposed within the stationary cavity and partially disposed within the movable cavity, an exercise deck is attached to at least one of the base and the upright structure, and an incline mechanism that adjusts the incline angle of the exercise deck. The incline mechanism is in communication with the worm gear. The worm gear rotates the threaded rod in response to the incline mechanism adjusting the angle of the exercise device.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. Often, the width of an object is transverse the object's length.

For purposes of this disclosure, relative motion between two upright structures is discussed as motion between a stationary portion (e.g. 304) and a height adjustable portion (e.g. 306), but it is understood that the relative motion can be achieved by reversing the actuator connection points, wherein the stationary portion becomes adjustable, and the adjustable portion becomes relatively stationary.

Figure 1:
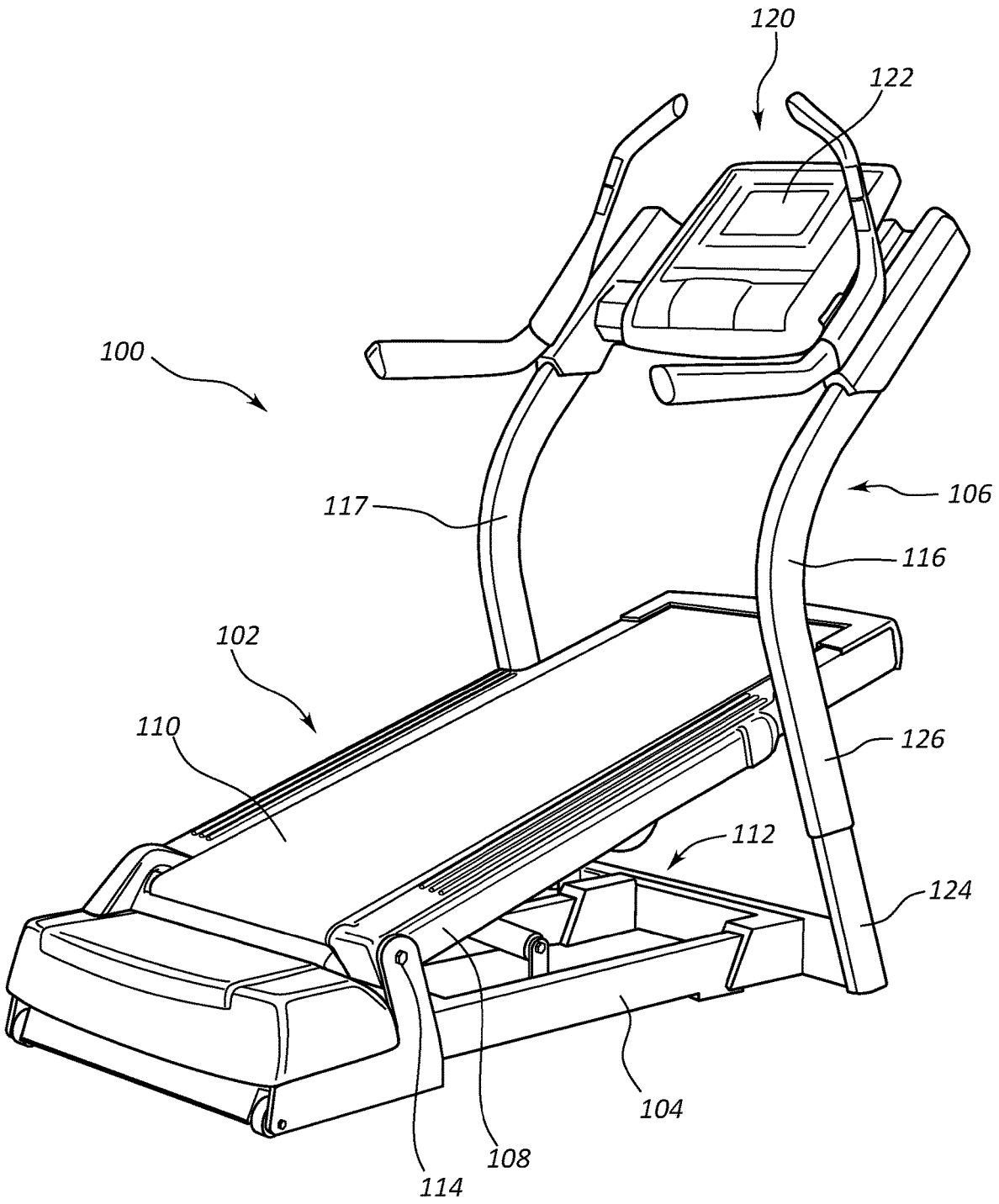
FIG. 1 illustrates a perspective view of an example of an exercise machine in accordance with the present disclosure.

FIG. 1 depicts an example of a treadmill 100 that includes a deck 102, a base 104, and an upright structure 106. The deck 102 includes a platform 108 with a front pulley connected to a front portion of the platform 108, and a rear pulley connected to a rear portion of the platform 108. A tread belt 110 surrounds a portion of the platform, the front pulley, and the second pulley. A motor (not shown) can drive either the front pulley or the rear pulley and cause the tread belt 110 to move along a surface of the platform 108.

An incline mechanism 112 is integrated into the base 104 and controls an elevation of the front portion of the deck 102. The rear portion of the deck is connected to the base 104 at a pivot connection 114. As the incline mechanism raises the front portion of the deck, the rear portion of the deck 102 remains connected to the base 104, thus, the front portion of the deck 102 inclines with respect to the base 104.

An upright structure 106 is connected to the base 104. In this example, the upright structure 106 includes a first post 116 and a second post 117. The first post 116 and the second post support a console 120. The console 120 includes a display 122.

The upright structure 106 includes a stationary portion 124 connected to the base 104, and a height adjustable portion 126 connected to the stationary portion 124. A linear actuator (not shown) is disposed within at least one of the first post 116 and the second post. The linear actuator moves the height adjustable portion in response to a command from a user. In the example of FIG. 1, the deck 102 is inclined, and the height adjustable portion 126 is elevated.

Figure 2:
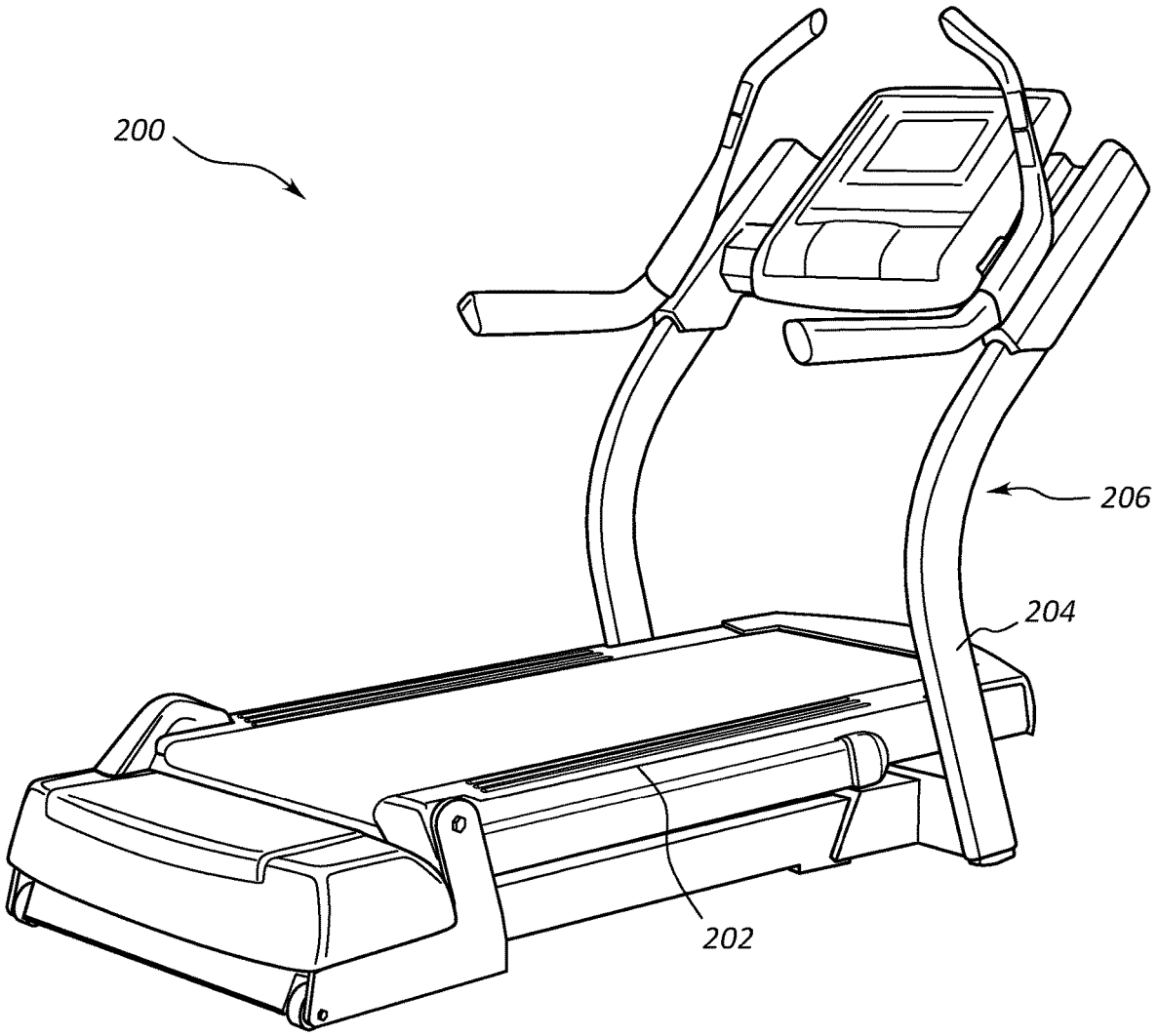
FIG. 2 illustrates a perspective view of an example of a height adjustable caster assembly in an exercise machine in accordance with the present disclosure.

FIG. 2 depicts an example of the treadmill 200 depicted in FIG. 1, except that the deck 202 is declined with respect to FIG. 1 and the height adjustable portion 204 of the upright structure 206 is lowered with respect to FIG. 1.

Figure 3:
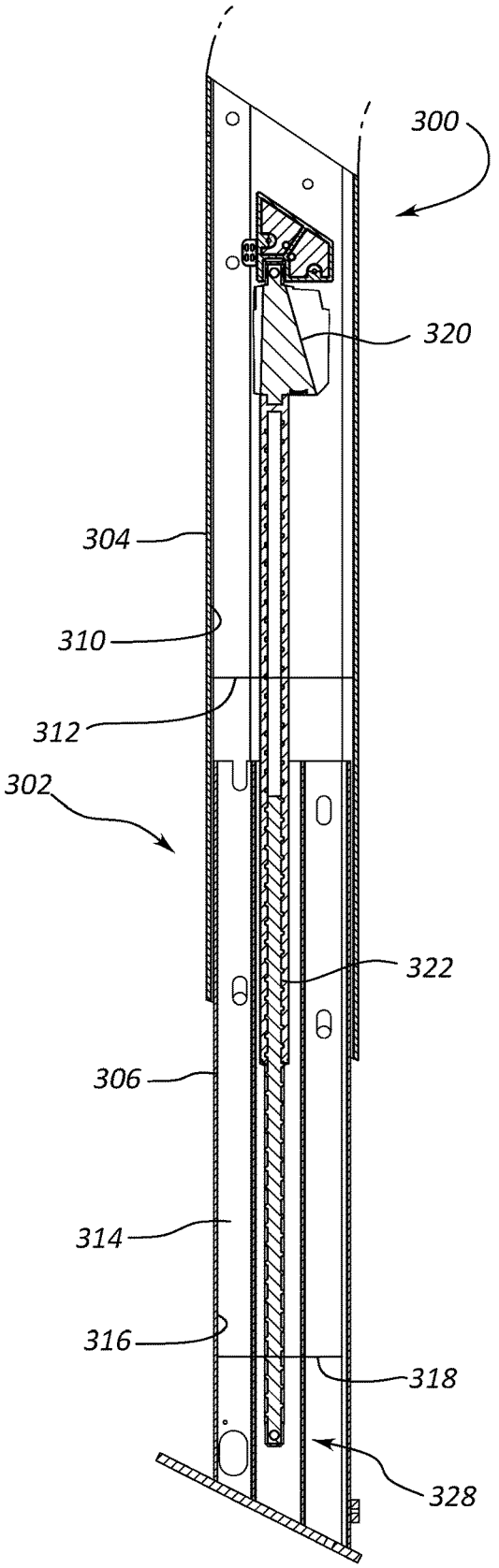
FIG. 3 illustrates a perspective view of an example of a linear actuator in an exercise machine in accordance with the present disclosure.
Figure 4:
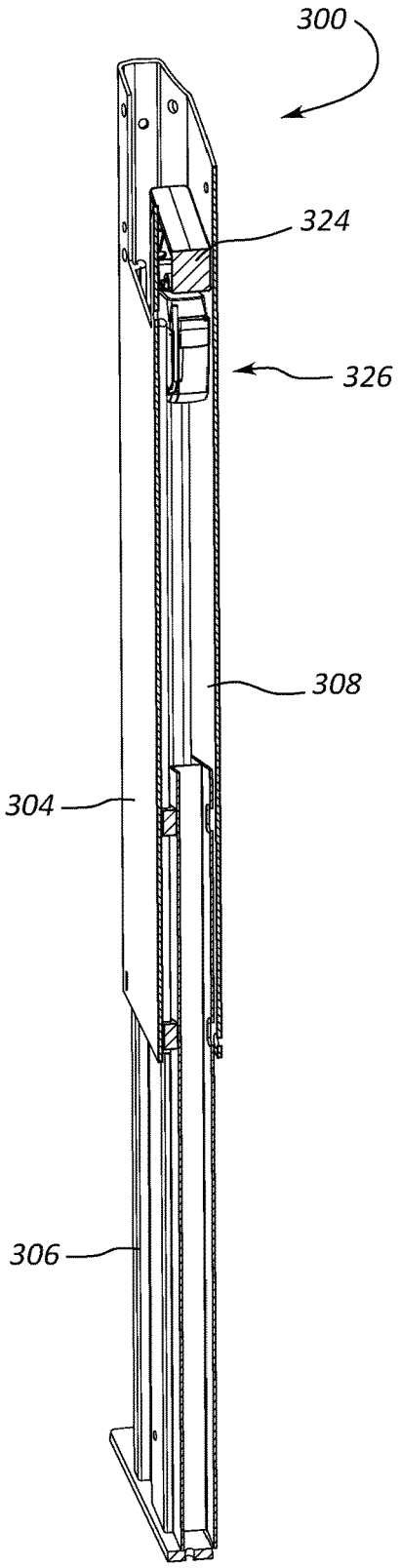
FIG. 4 illustrates a perspective view of an example of a linear actuator in an exercise machine in accordance with the present disclosure.

FIGS. 3 and 4 depict examples of a linear actuator 300. In these examples, the post 302 include a stationary portion 304 and a height adjustable portion 306. The stationary portion 304 includes a stationary cavity 308 defined by an inner stationary surface 310. The stationary cavity 308 includes an internal stationary width 312. The height adjustable portion 306 includes a movable cavity 314 defined by an inner movable surface 316. The movable cavity 314 includes an internal movable width 318. The internal stationary width 312 is greater than the internal movable width 318. A region of the movable portion of the height adjustable portion 306 resides within the stationary cavity 308, and the inner stationary surface 310 guides the height adjustable portion 306 when the linear actuator 300 applies a force to move the movable height adjustable portion 306.

In this example, the linear actuator 300 is partially disposed in the stationary portion 304 of a post 302 and partially disposed in a height adjustable portion 306 of the post 302. In this example, the linear actuator 300 is a screw linear actuator with a worm gear 320 and a threaded rod 322 with a thread form that meshes with the worm gear 320.

A motor 324 may also be disposed within the post 302. A first rod end 326 may be in communication with the motor 324. The threaded rod 322 is partially disposed within the stationary cavity 308 and partially disposed within the movable cavity 314. The threaded rod 322 includes a second rod end 328 connected to the height adjustable portion 306. Alternatively, the second rod end of the threaded rod is connected to the stationary section of the post.

In those situations where the linear actuator causes the threaded rod to rotate in a first direction, the threaded rod moves so that the height adjustable portion is moved away from the motor. In other situations, the linear actuator causes the treaded rod to rotate in a second direction that is opposite the first direction, so that the height adjustable portion moves closer to the motor.

Figure 5:
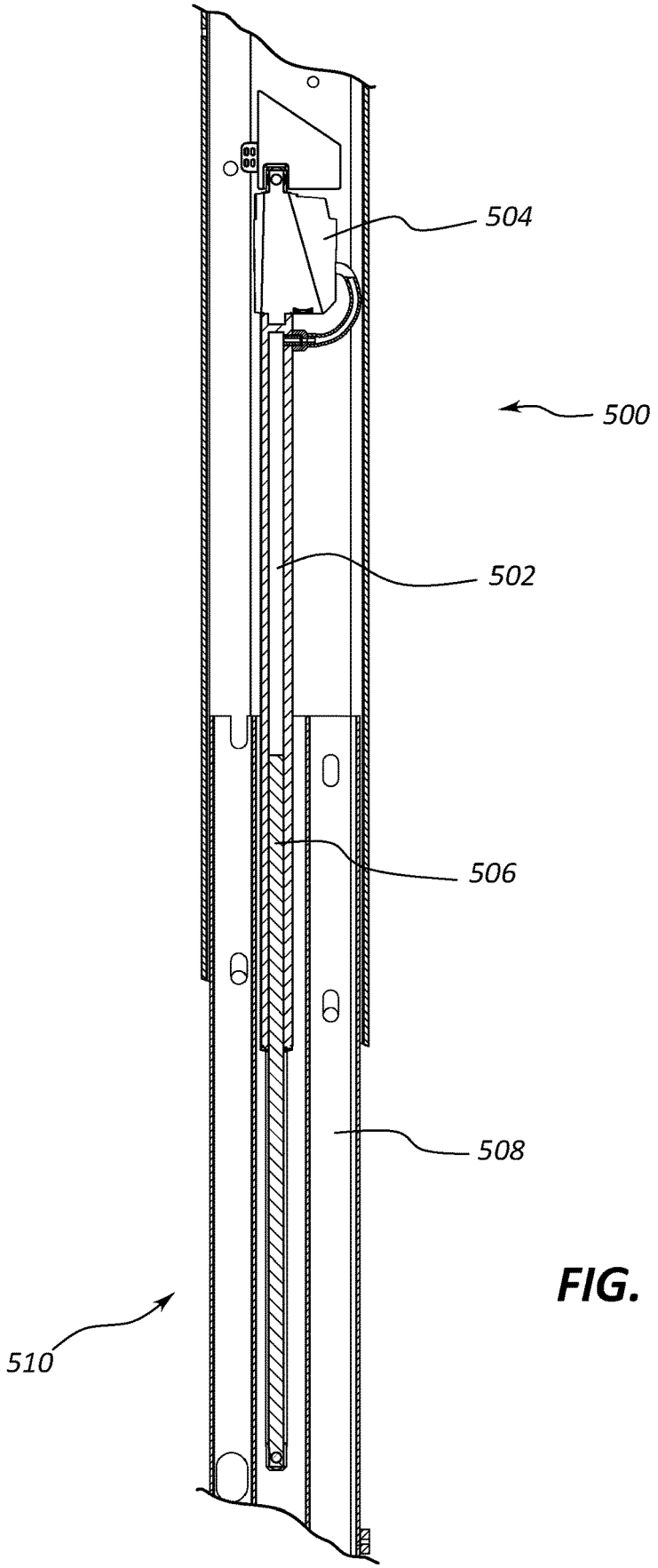
FIG. 5 illustrates a perspective view of an example of a linear actuator in an exercise machine in accordance with the present disclosure.

FIG. 5 depicts an example of an alternative linear actuator 500. In this example, the linear actuator 500 includes a chamber 502 that is capable of being filled with a gas or a liquid. A pump 504 may fill the chamber 502 with either pneumatic pressure or with hydraulic pressure. In response, a piston 506 may be displaced by the pressure in the chamber 502 causing the piston 506 to move. The piston 506 may be connected to the height adjustable portion 508 of the post 510. Thus, as the chamber 502 is pressurized, the height adjustable portion 508 is moved. Likewise, when the chamber 502 is depressurized and the piston 506 retracts, the height adjustable portion 508 is also retracted.

Figure 6:
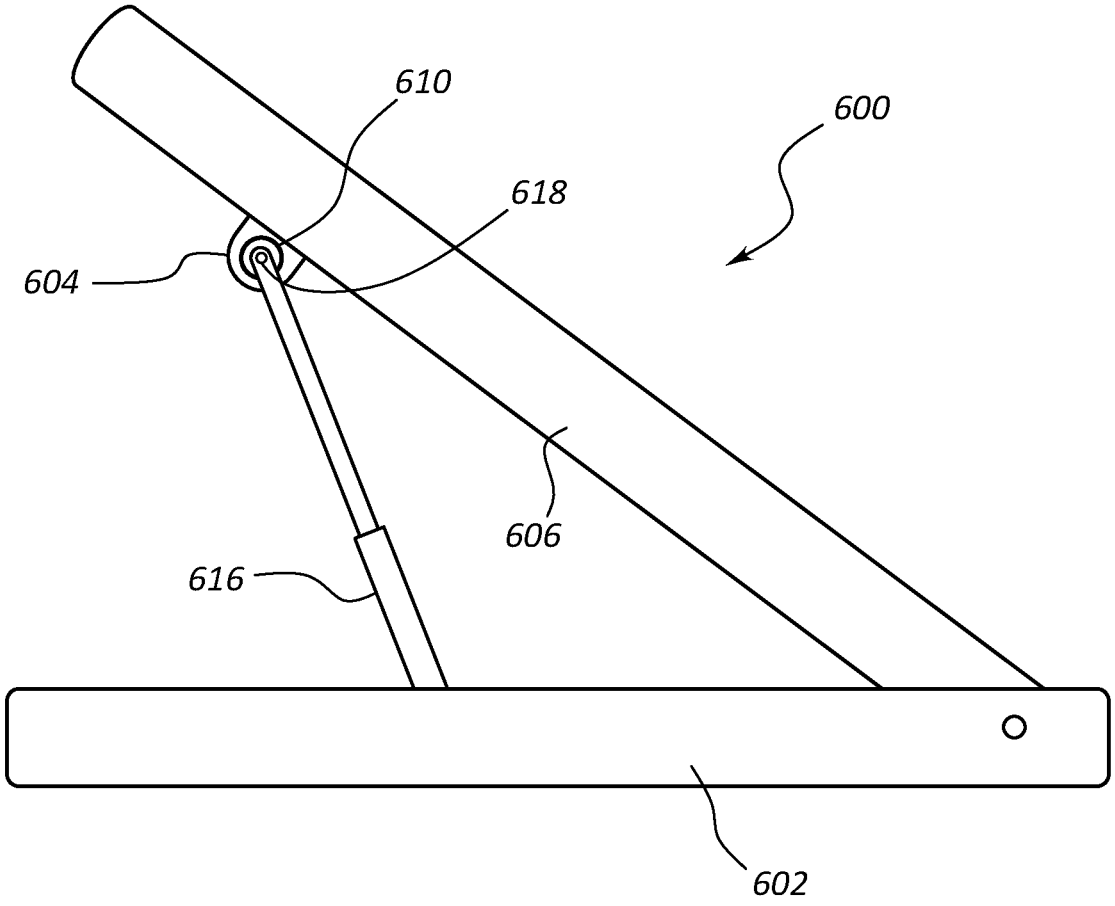
FIG. 6 illustrates a perspective view of an example of an incline mechanism in an exercise machine in accordance with the present disclosure.
Figure 7:
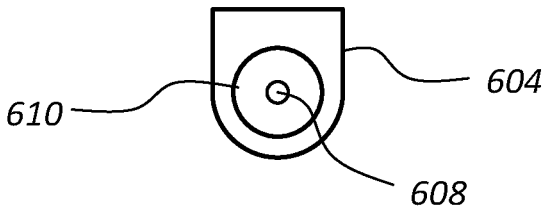
FIG. 7 illustrates a perspective view of an example of a vibration reduction element in accordance with the present disclosure.

FIGS. 6 and 7 depict an example of an incline mechanism. In this example, the exercise deck 600 is attached to the base 602, and the incline mechanism adjusts the incline angle of the exercise deck 600. A protrusion 604 may be attached to an underside 606 of the exercise deck 600. An opening 608 is defined in the protrusion 604, and a vibration reduction element 610 is incorporated into the protrusion 604. In this example, the vibration reduction element 610 includes an elastic liner attached to the inner surface that defines the opening 608.

The incline mechanism also includes an expandable element 616. A first end of the expandable element 616 is connected to the protrusion 604, and a second end of the expandable element 616 is connected to the base 602. A fastener 618 of the first end is in contact with the vibration reduction element 610. As the expandable element causes the exercise deck angle to change, the vibrations that would otherwise be caused by this movement are absorbed in to the vibration reduction element. This may have the advantage of reducing sounds while the exercise deck is changing its incline angle.

In some examples, the incline mechanism is in communication with the linear actuator so that when the linear actuator moves the height adjustable portion in response to the incline mechanism adjusting the angle of the exercise device. The incline angle may change its angle based on commands from the user, such as commands through an input mechanism incorporated into the console. In other examples, the incline mechanism may be activated based on a programmed exercise routine that simulates a real world route.

General Description

In general, the invention disclosed herein may provide users with an exercise machine that has an upright structure with a height adjustable portion. A console may be attached to the height adjustable portion, so that when the height of the height adjustable portion is changed, the elevation of the console also changes. In some cases, the elevation of the console changes automatically as the incline mechanism changes the angle of the exercise deck.

In some cases, the invention disclosed may provide the users with an exercise machine that includes a vibration reduction element that prevents and/or eliminates at least some of the vibrations that can be caused at the connection of a rod of the incline mechanism and the underside of the exercise deck. In examples with a vibration reduction element, the underside of the exercise deck may include protrusions with an opening defined therein. The opening may receive a fastener that connects the protrusion to the expandable element. A vibration reduction element may be incorporated into the protrusion. In one example, the vibration reduction element includes an elastic liner that is connected to the inner surface of the protrusion that defines the opening and is in contact with the fastener. As movement between the fastener and the protrusion is caused due to the relative movement between the expandable element and the protrusion, the elastic liner absorbs forces caused by the relative movement resulting in a reduction and/or elimination of the vibrations.

In some examples, the exercise machine is a treadmill. The treadmill may include an exercise deck. The exercise deck may include a platform that has a first pulley located in a front portion of the deck and a second pulley located in a rear portion of the deck. A tread belt may surround the first and second pulleys and provide a surface on which the user may exercise. At least one of the first pulley and the second pulley may be connected to a motor so that when the motor is active, the pulley rotates. As the pulley rotates, the tread belt moves as well. The user may exercise by walking, running, or cycling on the tread belt's moving surface. In other examples, the tread belt is moved with the user's own power.

The exercise deck may be capable of having its front portion raised and lowered as well as its rear portion raised and lowered to control the lengthwise slope of the running deck. With these elevation controls, the orientation of the running deck can be adjusted as desired by the user or as instructed by a programmed workout.

In some cases, the treadmill includes an upright structure and a console connected to the upright structure. The console may include a display, an input mechanism for controlling various features and/or operational controls of the treadmill, an energy efficiency indicator, a speaker, a fan, another component of the treadmill, or combinations thereof.

The console may locate the input mechanism within a convenient reach of the user to control the operating parameters of the exercise deck. For example, the control console may include controls to adjust the speed of the tread belt, adjust a volume of a speaker integrated into the treadmill, adjust an incline angle of the running deck, adjust a decline of the running deck, adjust a lateral tilt of the running deck, select an exercise setting, control a timer, change a view on a display of the control console, monitor the user's heart rate or other physiological parameters during the workout, perform other tasks, or combinations thereof. Buttons, levers, touch screens, voice commands, or other mechanisms may be incorporated into the console incorporated into the treadmill and can be used to control the capabilities mentioned above. Information relating to these functions may be presented to the user through the display. For example, a calorie count, a timer, a distance, a selected program, an incline angle, a decline angle, a lateral tilt angle, another type of information, or combinations thereof may be presented to the user through the display.

The deck may be attached to a base. In some cases, the base includes a base frame that includes a first longitudinal frame member and a second longitudinal frame member that is aligned with the first longitudinal frame member. The first and second longitudinal frame members may be connected to each other through at least one cross member. In some cases, a forward cross member connects the first and second longitudinal frame members within a front portion of the frame. In some examples, a rearward cross member connects the first and second longitudinal frame members in a rear portion of the base. The base frame may have any appropriate number of longitudinal frame members and any appropriate number of cross members. The deck may be pivotally attached to a portion of the base. In some cases, a rearward end of the deck is pivotally attached to the base.

An incline mechanism may be used to raise and/or lower the front portion of the deck. In some embodiments, as the front portion of the deck is raised and lowered, the slope of the exercise deck changes as the rear portion of the deck remains pivotally connected to the base. Any appropriate type of incline mechanism may be used in accordance with the principles described in the present disclosure. The incline mechanism may include an expandable element. In some cases, the expandable element is a retractable cylinder that has a first end connected to the deck and a second end attached to the base. The expandable element may extend to elevate the front portion of the deck or retract to lower the front portion of the deck. In some examples, the expandable element includes multiple cylinders that are used to raise and lower the front portion of the deck. These cylinders may operate simultaneously or sequentially to raise and/or lower the front portion of the deck. Further, at least one cylinder used to raise and lower the front portion of the deck may be a multi-stage cylinder or a single stage cylinder.

In another embodiment, a portion of the incline mechanism is incorporated into the upright structure. In one of these types of examples, a track may be incorporated into at least one of the first post and the second post of the upright structure. The portion of the deck may be connected to posts and movable within the tracks of the posts. In one case, the track may be a rack, and a pinion is attached to the deck. As the pinions rotate, the track moves in accordance with the direction that the pinion is rotating. In another example, the front portion of the track may be connected to posts through a cable that is spooled about a winch. As the winch unwinds, the incline mechanism lowers the front portion of the deck. Conversely, as the winch winds up the cable, the front portion of the track is lifted.

A belt motor may be used to move the treadmill's belt. The belt motor may be located in any appropriate location on the treadmill. For example, the belt motor may be located proximate the first pulley or the second pulley. The belt motor may drive the rotation of at least one of the pulleys to cause the tread belt to move. In some cases, the motor is connected to the pulley through a transmission belt, a gear set, another transmission mechanism, or combinations thereof. The belt motor may be located in the base and connect to the rear pulley in those situations where the rear pulley shares a rotational axis with the pivot connection attaching the deck to the base. In other examples, the belt motor may be located in the deck with the pulley. One advantage to having the belt motor in the base is that the belt motor's weight can contribute to the weight of the base to stabilize the treadmill and the incline mechanism has less weight to support as it raises and lowers the front portion of the deck.

In one example, the exercise machine includes a base attached to an upright portion. The upright portion may include a stationary portion connected to the base, and a height adjustable portion connected to the stationary portion. The stationary portion may be stationary with respect to the height adjustable portion. The height adjustable portion may be movable with respect to the stationary portion. In some cases, the stationary portion guides the movement of the height adjustable portion. A linear actuator may be positioned between the height adjustable portion and the stationary portion. When the linear actuator is activated, the linear actuator may cause the height adjustable portion of the upright console to move in a first direction to increase the height of the upright portion or to move in a second direction that is opposite the first direction to decrease the overall height of the upright portion.

A console may be connected to the upright structure. In some cases, the upright structure includes a first post supporting the console and a second post supporting the console. The first and second posts may be disposed on either side of the exercise deck.

The stationary portion of the upright structure may include a stationary cavity defined by an inner stationary surface of a stationary section of the first post. The cavity may include an internal stationary width. Also, the height adjustable portion may include a movable cavity defined by an inner movable surface of a movable portion of the first post. The movable cavity may include an internal movable width. In some cases, the internal stationary width is greater than the internal movable width. In alternative examples, the internal stationary width is less than the internal movable width. In those cases where the internal stationary width is greater, a region of the movable portion can reside within the stationary cavity, and the inner stationary surface can guide the movable portion when the linear actuator applies a force to move the movable section. In those examples, where the internal stationary width is less than the internal movable width, a region of the stationary portion of the post may reside within the internal movable cavity.

In some cases, the external surfaces of the stationary cavity are a guide to direct the height adjustment portion of the posts as the linear actuator is activated. In those examples where the movable portion of the upright structure is disposed within the stationary cavity, the internal surfaces that define the stationary cavity guide the movement of the movable portion of the posts when the linear actuator is activated.

In some cases, a single linear actuator is disposed in just one of the first post and the second post. In other examples, each of the first post and the second post includes an independent linear actuator. In these examples, the linear actuators may be synchronized to operate simultaneously with each other. The incorporation of a linear actuator to simultaneously synchronize the movement of the first and second post prevents friction or binding caused by non-linear motion that often burns up or breaks traditional lift actuators.

The linear actuator may be positioned in either the stationary cavity, the movable cavity, or a combination thereof. In one example, a first end of the linear actuator is disposed within the stationary cavity, and a second end of the linear actuator is disposed within the movable cavity. Each of the first end and the second end may be connected to their respective cavities, so that when the linear actuator applies a force to expand or retract the height adjustment portion, the loads to move the height adjusted portion are transferred to the stationary portion and height adjustable portion through the connections of the first and second ends.

Any appropriate type of linear actuator may be used in accordance with the principles described in the present disclosure. In some examples, a motor is disposed within one of the first post and the second post. Further, the linear actuator may include a threaded rod, and a first rod end of the threaded rod is in communication with the motor. The threaded rod may be partially disposed within the stationary cavity and partially disposed within the movable cavity. Also, the threaded rod may include a rod end connected to the movable section of the post or the stationary portion of the post. The other end of the rod may be connected to the motor. If the second end of the rod is connected to the stationary portion, the motor may be disposed within the height adjustable portion. In other examples, if the motor is disposed in the height adjustable portion, the other end of the threaded rod may be connected to the stationary portion.

The threaded rod may be rotated by the motor in a first direction to raise the height adjustable portion or rotated in a second direction opposite the first direction to lower the height adjustable portion. The motor may drive a worm gear that meshes with the thread form of the threaded rod. As the motor rotates the worm gear, the gear's teeth may apply a force on the thread form causing the threaded rod to rotate. In those examples where the motor is in the stationary portion, the threaded rod may be connected to the height adjustable portion through a complementary threaded opening. Thus, as the threaded rod rotates, the threaded rod pushes the height adjustable portion in the respective direction through the complementary threaded opening. In some examples, the threaded rod is connected to the height adjustable portion through at least one protrusion that meshes with the rod's thread form. In some cases, multiple protrusions mesh with the threaded rod's thread form. The collective meshing of the protrusions with the threaded rod's thread form cause a load to be passed from the threaded rod to the height adjustable portion as the rod rotates.

In other examples, the linear actuator may include a hydraulic chamber or a pneumatic chamber. A piston may be disposed in the chamber so that the piston moves when a hydraulic or pneumatic pressure within the chamber forces the piston forward or retracts the piston backwards. In this example, the piston may be connected to the height adjustable portion of the upright structure so that when the piston moves, the height adjustable portion also moves. In other examples, the linear actuator may include magnets that are used to move the height adjustable portion. These magnets may be part of a solenoid. In other examples, the magnets may be used to repel a feature that is connected to the height adjustable portion, so when the magnets cause that feature to move, the height adjustable portion also moves.

In some examples, the linear actuator is in communication with the incline mechanism. In one case, when the incline mechanism sends a command to the linear actuator in response to movement of the incline mechanism. For example, if the incline mechanism increments the angle of the exercise deck, the incline mechanism may send a command to the linear actuator to move the height adjustable portion a corresponding distance. In the same example, if the incline mechanism decrements the angle of the exercise deck, the incline mechanism may send a command to the linear actuator to lower the height adjustable portion a corresponding distance. In yet other examples, when a user sends a command to the incline mechanism to change the angle of the exercise deck, a separate command may be automatically generated for the linear actuators to move the height adjustable portion in response to the user's command to the incline mechanism. In another example where the exercise machine includes the capability of using pre-programmed exercise routines that automatically move the exercise deck (such as a program that simulates a real world running trail or simulates an experience in a remote terrain), the programmed instructions causing commands to be sent to the incline mechanism may also send commands to the linear actuator to cause the height adjustable portion to move. Thus, instructions to move the height adjustable portion may occur in response to commands from the user to adjust the deck's incline angle, commands from a program controlling at least some of the operation parameters of the exercise machine, or from user commands to specifically cause the height adjustable portion to move independently of commands to change the incline of the deck or another aspect of the exercise machine. For example, different users may have different heights, so the user may desire to change the height of the console even when the incline angle of the exercise deck has not changed. In another example, a sensor may determine when the linear actuators are to be activated to change the console's height. For example, a sensor may be used to determine the height of the user, the angle of the exercise deck, another parameter of the exercise machine, another factor, or combinations thereof. In response to the sensor's readings, the sensors or a processor in communication with the sensor may cause a command to be generated to change the height of the height adjustable portion.

Any appropriate type of incline mechanism may be used in accordance with the principles described in the present disclosure. In some embodiments, the incline mechanism includes an expandable element. A first end of the expandable element attaches to the underside of the exercise deck. A second end of the expandable element attaches to the base. In some of these types of examples, the incline mechanism includes a protrusion that is fixed to the underside of the exercise deck. The protrusion may include an opening defined therein that is sized and shaped to receive a fastener that connects to the expandable element.

The protrusion may include a vibration reduction element that reduces and/or eliminates sounds that are generated from the relative movement of the expandable element and the protrusion. Any appropriate type of vibration reduction element may be used in accordance with the principles described in the present disclosure. In one example, the vibration reduction element includes an elastomeric material that lines an inside surface of the protrusion that defines the opening. The elastomeric material may absorb some of the forces that are involved between the protrusion and the expandable element as they move relative to each other. In some cases, the opening is lined with a low friction material. Further, the elastomeric material may also be lined with the low friction material.

Any appropriate type of elastomeric material may be used in accordance with the principles described in the present disclosure. A non-exhaustive list of elastomeric materials that may be used include aromatic polyurethane elastomeric alloys, rubber, silicone, latex, Unsaturated rubbers, natural polyisoprene: cis-1,4-polyisoprene natural rubber, synthetic polyisoprene, polybutadiene, chloroprene rubber, polychloroprene, neoprene, Baypren, butyl rubber, syrene-butadiene rubber, nitrile rubber, hydrogenated nitrile rubbers, ethylene propylene rubber, epichlorohydrin rubber, polyacrylic rubber, silicone rubber, fluorosilicone, rubber, fluoroelastomers, Viton, Tecnoflon, Fluorel, Aflas, perfluoroelastomers, polyether block amides, chlorosulfonated polyethylene, and ethylene-vinyl acetate, thermoplastic elastomers, proteins resilin and elastin, polysulfide rubber, elastoefin, another type of material, or combinations thereof.

Any appropriate type of low friction material may be used in accordance with the principles described in the present disclosure. A non-exhaustive list of low friction materials may include phenolics, nylon, teflon, acetal, ultrahigh-molecular-weight polyethylene, polyimide, polysulfone, polyphenylene sulfide, low friction plastics, a lubricated acetal resin, polytetrafluoroethylene, another type of material, or combinations thereof. The low friction material may be applied as a coating, but the low friction material may applied through any appropriate mechanism.

The linear actuator may include a combination of hardware and programmed instructions for executing the functions of the height adjustment caster assemblies. The linear actuator may include processing resources that are in communication with memory resources. Processing resources include at least one processor and other resources used to process the programmed instructions. As described herein, the memory resources may represent generally any memory capable of storing data such as programmed instructions or data structures used by the height adjustment caster assemblies.

The processing resources may include I/O resources that are capable of being in communication with a remote device that stores the user information, workout history, external resources, databases, or combinations thereof. The remote device may be a mobile device, a cloud based device, a computing device, another type of device, or combinations thereof. In some examples, the height adjustment caster assemblies communicates with the remote device through a mobile device which relays communications between the height adjustment caster assemblies and the remote device. In other examples, the mobile device has access to information about the user.

The remote device may execute a program that can provide useful information to the height adjustment caster assemblies. An example of a program that may be compatible with the principles described herein includes the iFit program which is available through www.ifit.com. An example of a program that may be compatible with the principles described in this disclosure is described in U.S. Pat. No. 7,980,996 issued to Paul Hickman. U.S. Pat. No. 7,980,996 is herein incorporated by reference for all that it discloses. In some examples, the user information accessible through the remote device includes the user's age, gender, body composition, height, weight, health conditions, other types of information, or combinations thereof.

The processing resources, memory resources, and remote devices may communicate over any appropriate network and/or protocol through the input/output resources. In some examples, the input/output resources includes a transmitter, a receiver, a transceiver, or another communication device for wired and/or wireless communications. For example, these devices may be capable of communicating using the ZigBee protocol, Z-Wave protocol, BlueTooth protocol, Wi-Fi protocol, Global System for Mobile Communications (GSM) standard, another standard, or combinations thereof. In other examples, the user can directly input some information into the pacing mechanism through a digital input/output mechanism, a mechanical input/output mechanism, another type of mechanism, or combinations thereof.

The memory resources may include a computer readable storage medium that contains computer readable program code to cause tasks to be executed by the processing resources. The computer readable storage medium may be a tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic based memory, other types of memory, or combinations thereof.

The memory resources may include an input recognition, which represents programmed instructions that cause the processor to recognize when a user has sent a command to the incline member. The input recognition may determine which direction to move the exercise deck based on the user's commands. The memory resources may also include a command generator, which represents programmed instructions that cause the processor to generate a command to cause the linear actuator to move. This command generator may be used to create a command to cause the motor associated with the worm gear, a hydraulic mechanism, a pneumatic mechanism, or another type of mechanism to move thereby causing the height adjustment mechanism to move as well. In some cases, the linear actuator is in communication with remote devices so that the user can cause the height of the console to be changed when the user is away from the exercise machine. Further, user preferences may be stored in the exercise device or in the remote device so that the exercise machine adjusts the height of the console without the user having to instruct for a change in the console height.

Further, the memory resources may be part of an installation package. In response to installing the installation package, the programmed instructions of the memory resources may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the program instructions are already installed. Here, the memory resources can include integrated memory such as a hard drive, a solid state hard drive, or the like.

In some examples, the processing resources and the memory resources are located within the exercise machine, a mobile device, an external device, another type of device, or combinations thereof. The memory resources may be part of any of these device's main memory, caches, registers, non-volatile memory, or elsewhere in their memory hierarchy. Alternatively, the memory resources may be in communication with the processing resources over a network. Further, data structures, such as libraries or databases containing user and/or workout information, may be accessed from a remote location over a network connection while the programmed instructions are located locally.

What is claimed is:

1. An exercise device, comprising:

a base;

an exercise deck attached to the base;

an incline mechanism configured to adjust an incline angle of the exercise deck;

an upright structure connected to the base, the upright structure including:

a stationary portion connected to the base;

a height adjustable portion connected to the stationary portion; and at least one linear actuator connected to both the stationary portion and the height adjustable portion;

wherein the at least one linear actuator moves the height adjustable portion relative to the stationary portion in response to a command from a user.

2. The exercise device of claim 1, wherein the upright structure further comprises:

a console;

a first post supporting the console; and a second post supporting the console;

wherein the at least one linear actuator is incorporated into the first post or the second post, or a first linear actuator of the at least one actuator is incorporated into the first post and a second linear actuator of the at least one actuator is incorporated into the second post.

3. The exercise device of claim 2, wherein the stationary portion comprises:

a stationary cavity defined by an inner stationary surface of a stationary section of the first post;

the stationary cavity including an internal stationary width;

wherein the height adjustable portion includes:

a movable cavity defined by an inner movable surface of a movable portion of the first post;

the movable cavity including an internal movable width;

the internal stationary width being greater than the internal movable width;

wherein a region of the movable portion resides within the stationary cavity; and wherein the inner stationary surface guides the movable portion when the at least one linear actuator applies a force to move the movable portion.

4. The exercise device of claim 3, further comprising:

a motor disposed within the first post;

a threaded rod; and a first rod end in communication with the motor;

wherein the threaded rod is partially disposed within the stationary cavity and partially disposed within the movable cavity.

5. The exercise device of claim 4, wherein the threaded rod includes a second rod end connected to the movable portion of the first post.

6. The exercise device of claim 4, wherein the threaded rod includes a second rod end connected to the stationary section of the first post.

7. The exercise device of claim 1, wherein the at least one linear actuator comprises a screw linear actuator.

8. The exercise device of claim 7, wherein the screw linear actuator includes:

a worm gear; and a threaded rod with a thread form that meshes with the worm gear.

9. The exercise device of claim 8, wherein the incline mechanism is in communication with the worm gear, and wherein the worm gear rotates the threaded rod in response to the incline mechanism adjusting the incline angle of the exercise deck.

10. The exercise device of claim 1, wherein the incline mechanism comprises:

a protrusion attached to an underside of the exercise deck;

an opening defined in the protrusion; and a vibration reduction element incorporated into the protrusion.

11. The exercise device of claim 10, wherein the vibration reduction element includes an elastic liner attached to the opening.

12. The exercise device of claim 10, wherein the incline mechanism comprises:

an expandable element;

a first end of the expandable element being connected to the protrusion;

a second end of the expandable element being connected to the base; and a fastener of the first end being in contact with the vibration reduction element.

13. The exercise device of claim 1, wherein the exercise device comprises a treadmill.

14. The exercise device of claim 1, wherein the incline mechanism is in communication with the at least one linear actuator;

wherein the at least one linear actuator moves the height adjustable portion in response to the incline mechanism adjusting an angle of the exercise device.

* * * * *